US009656220B2

(12) United States Patent
Johnston et al.

(10) Patent No.: US 9,656,220 B2
(45) Date of Patent: May 23, 2017

(54) METHOD AND APPARATUS FOR ATOMIZING A DEPOSITION MIXTURE

(71) Applicant: The Boeing Company, Chicago, IL (US)

(72) Inventors: Scott Robert Johnston, St. Louis, MO (US); Melody Rose Bennett, O'Fallon, MO (US); Michael Ray Miller, Lake St. Louis, MO (US)

(73) Assignee: THE BOEING COMPANY, Chicago, IL (US)

( * ) Notice: Subject to any disclaimer, the term of this patent is extended or adjusted under 35 U.S.C. 154(b) by 331 days.

(21) Appl. No.: 14/182,040

(22) Filed: Feb. 17, 2014

(65) Prior Publication Data

US 2015/0231578 A1 Aug. 20, 2015

(51) Int. Cl.

| | |
|---|---|
| ***B05B 17/06*** | (2006.01) |
| ***B05B 1/08*** | (2006.01) |
| ***B05C 11/00*** | (2006.01) |
| ***B01F 3/04*** | (2006.01) |
| ***B01F 15/06*** | (2006.01) |
| ***B05C 5/00*** | (2006.01) |
| ***B01F 3/12*** | (2006.01) |
| ***B01F 11/02*** | (2006.01) |
| *B01F 3/00* | (2006.01) |

(52) U.S. Cl.

CPC ..... *B01F 3/1242* (2013.01); *B01F 11/0266* (2013.01); *B05B 17/0615* (2013.01); *B05C 5/00* (2013.01); *B01F 2003/0028* (2013.01)

(58) Field of Classification Search

USPC ..... 118/300, 302, 666, 667; 239/102.1, 239/102.2, 708; 128/200.16

See application file for complete search history.

(56) References Cited

U.S. PATENT DOCUMENTS

| | | | | |
|---|---|---|---|---|
| 3,997,113 | A * | 12/1976 | Pennebaker, Jr. | B41J 2/215 101/DIG. 37 |
| 6,338,809 | B1 * | 1/2002 | Hampden-Smith | B01J 2/003 257/E21.304 |
| 2007/0277816 | A1 * | 12/2007 | Morrison | A61M 11/005 128/200.16 |
| 2008/0223953 | A1 * | 9/2008 | Tomono | A01M 1/205 239/102.2 |
| 2013/0044155 | A1 * | 2/2013 | Duce | H01L 41/1132 347/19 |

OTHER PUBLICATIONS

Kahn, "The M3D Aerosol Jet System, an Alternative to Inkjet Printing for Printed Electronics," www.organicandprintedelectronics.com, copyright Winter 2007, vol. 1, Issue 2, pp. 13-17.

"Aerosol Jet Printing," Fraunhofer-Gesellschaft, Fraunhofer Institute for Electronic Nano Systems ENAS, 2 pages, accessed Jan. 7, 2014. http://www.enas.fraunhofer.de/content/dam/enas/de/documents/Downloads/Datenbl%C3%A4tter/AerosolJetPrinting_EN_web.pdf.

* cited by examiner

*Primary Examiner* — Yewebdar Tadesse
(74) *Attorney, Agent, or Firm* — Yee & Associates, P.C.

(57) ABSTRACT

A method and apparatus for forming an aerosol. An apparatus may comprise an inner chamber, an outer chamber located around the inner chamber, and a wave generating device associated with the outer chamber. The inner chamber may be configured to hold a mixture that is to be converted into an aerosol within the inner chamber. The outer chamber may be configured to hold a fluid. The wave generating device may be configured to generate waves that propagate through the fluid into the mixture to stir the mixture.

13 Claims, 7 Drawing Sheets

FIG. 8
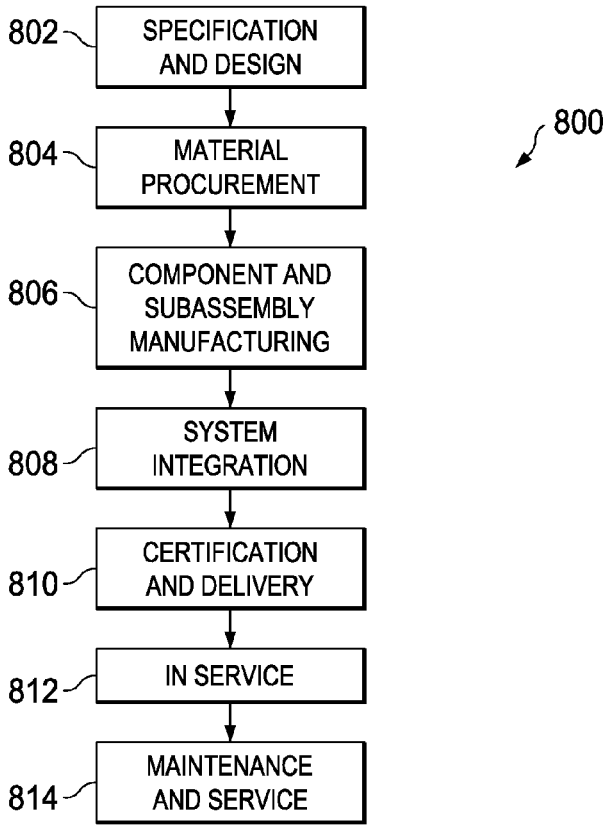
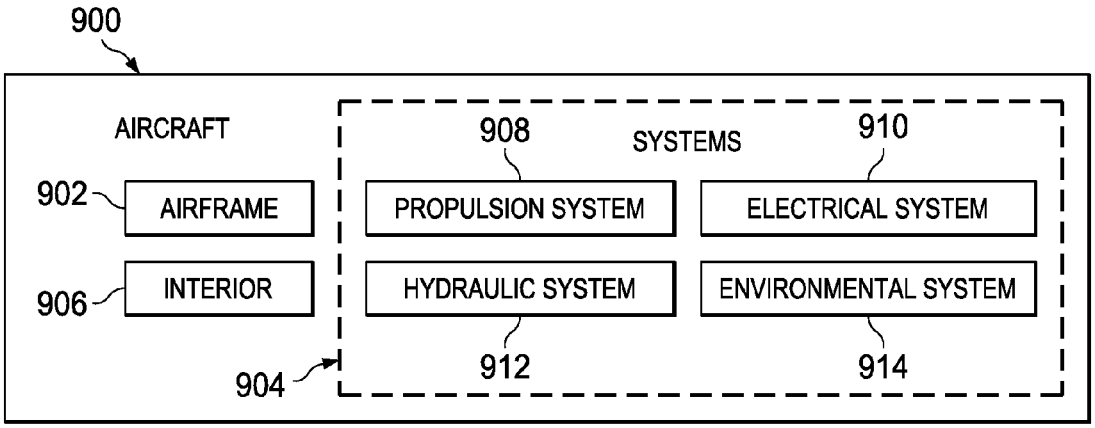
FIG. 9

METHOD AND APPARATUS FOR ATOMIZING A DEPOSITION MIXTURE

BACKGROUND INFORMATION

1. Field

The present disclosure relates generally to depositing material onto substrates and, in particular, to depositing magnetic material onto substrates. Still more particularly, the present disclosure relates to a method and apparatus for atomizing a mixture comprising magnetic particles for an aerosol deposition process.

2. Background

Aerosol deposition may be used in the place of traditional printing techniques. These printing techniques may include, for example, without limitation, screen printing, inkjet printing, and lithography. Aerosol deposition may use an aerosol to "print" one or more layers of material onto a substrate. An aerosol, as used herein, may be a colloid of solid particles or liquid droplets in air or some other type of gas.

With aerosol deposition, the aerosol is sprayed onto the substrate in the form of a focused stream, or jet, of aerosol to deposit the one or more layers of material onto the substrate. Thus, aerosol deposition may also be referred to as aerosol jet deposition. Aerosol deposition may be used to create a variety of objects including, but not limited to, film transistors, resistors, printed circuit boards, and other types of printed electronic devices.

In some cases, the aerosol used in aerosol deposition may be produced by atomizing a solution comprised of a solvent and nanoparticles. As one illustrative example, an ink solution may be atomized to form an aerosol. The ink solution may be comprised of a solvent nanoparticles such as, for example, without limitation, silver nanoparticles, copper nanoparticles, plastic nanoparticles, or some other type of non-magnetic nanoparticles.

Aerosol deposition may allow printing with solutions that are more viscous than is allowed with traditional printing techniques. The solutions used in aerosol deposition may have viscosities up to about 5000 centiPoise (cP). These solutions may typically be comprised of nonmagnetic nanoparticles. A stirrer, typically magnetic, may be used to stir the solution to keep the solution homogeneous such that the aerosol produced is also homogeneous. A homogeneous aerosol may result in a better print quality than a heterogeneous aerosol.

In some cases, it may be desirable to use a solution comprised of magnetic nanoparticles. However, with a solution comprised of magnetic nanoparticles, a magnetic stirrer may be unable to effectively stir the solution to maintain the homogeneity of the solution. The magnetic nanoparticles may stick to and agglomerate around the magnetic stirrer. Thus, some other type of method of maintaining the homogeneity of the solution may be required. Therefore, it would be desirable to have a method and apparatus that take into account at least some of the issues discussed above, as well as other possible issues.

SUMMARY

In one illustrative embodiment, an apparatus may comprise an inner chamber, an outer chamber located around the inner chamber, and a wave generating device associated with the outer chamber. The inner chamber may be configured to hold a mixture that is to be converted into an aerosol within the inner chamber. The outer chamber may be configured to hold a fluid. The wave generating device may be configured to generate waves that propagate through the fluid into the mixture to stir the mixture.

In another illustrative embodiment, an atomization system may comprise an inner chamber, a pneumatic atomizer, an outer chamber located around the inner chamber, an ultrasonic transducer associated with the outer chamber, and a temperature-controlling device. The inner chamber may be configured to hold a liquid medium and a plurality of magnetic nanoparticles. The pneumatic atomizer may be configured to atomize the mixture using a high-velocity stream of gas to form an aerosol. The outer chamber may be configured to hold a fluid. The ultrasonic transducer may be configured to generate ultrasonic waves that propagate through the fluid into the mixture to ultrasonically stir the mixture to maintain homogeneity of the mixture such that the aerosol formed is substantially homogeneous. The temperature-controlling device may be configured to maintain a temperature of the fluid above a selected threshold to maintain a temperature of the mixture above the selected threshold.

In yet another illustrative embodiment, a method for forming an aerosol may be provided. A mixture held within an inner chamber may be atomized to form the aerosol within the inner chamber. Waves generated using a wave generating device may be propagated through a fluid held in an outer chamber around the inner chamber into the mixture to stir the mixture.

In still another illustrative embodiment, a method for performing aerosol jet deposition may be provided. A mixture held within an inner chamber may be atomized to form the aerosol within the inner chamber. The mixture may comprise a liquid medium and a plurality of magnetic nanoparticles. Ultrasonic waves may be generated using an ultrasonic transducer. The ultrasonic waves generated may be propagated through a fluid held in an outer chamber around the inner chamber into the mixture to ultrasonically stir the mixture to maintain homogeneity of the mixture such that the aerosol formed is substantially homogeneous. A portion of the plurality of magnetic nanoparticles may be deposited in the aerosol onto a surface of an object using a deposition head to form a deposition. The aerosol being substantially homogeneous may improve a quality of the aerosol as compared to when the aerosol is heterogeneous.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

FIG. 8 is an illustration of an aircraft manufacturing and service method in the form of a block diagram in accordance with an illustrative embodiment; and FIG. 9 is an illustration of an aircraft in the form of a block diagram in which an illustrative embodiment may be implemented.

DETAILED DESCRIPTION

The illustrative embodiments recognize and take into account different considerations. For example, the illustrative embodiments recognize and take into account that it may be desirable to have a method and apparatus for maintaining the homogeneity of an ink mixture comprised of magnetic nanoparticles. The illustrative embodiments recognize and take into account that ultrasonic waves may be used to "stir" the ink mixture.

Thus, the illustrative embodiments provide a method and apparatus for forming an aerosol. A mixture held within an inner chamber may be atomized to form the aerosol within the inner chamber. Waves generated using a wave generating device may be propagated through a fluid held in an outer chamber around the inner chamber into the mixture to maintain homogeneity of the mixture such that the aerosol formed is substantially homogeneous. The waves may be, for example, without limitation, ultrasonic waves.

Figure 1:
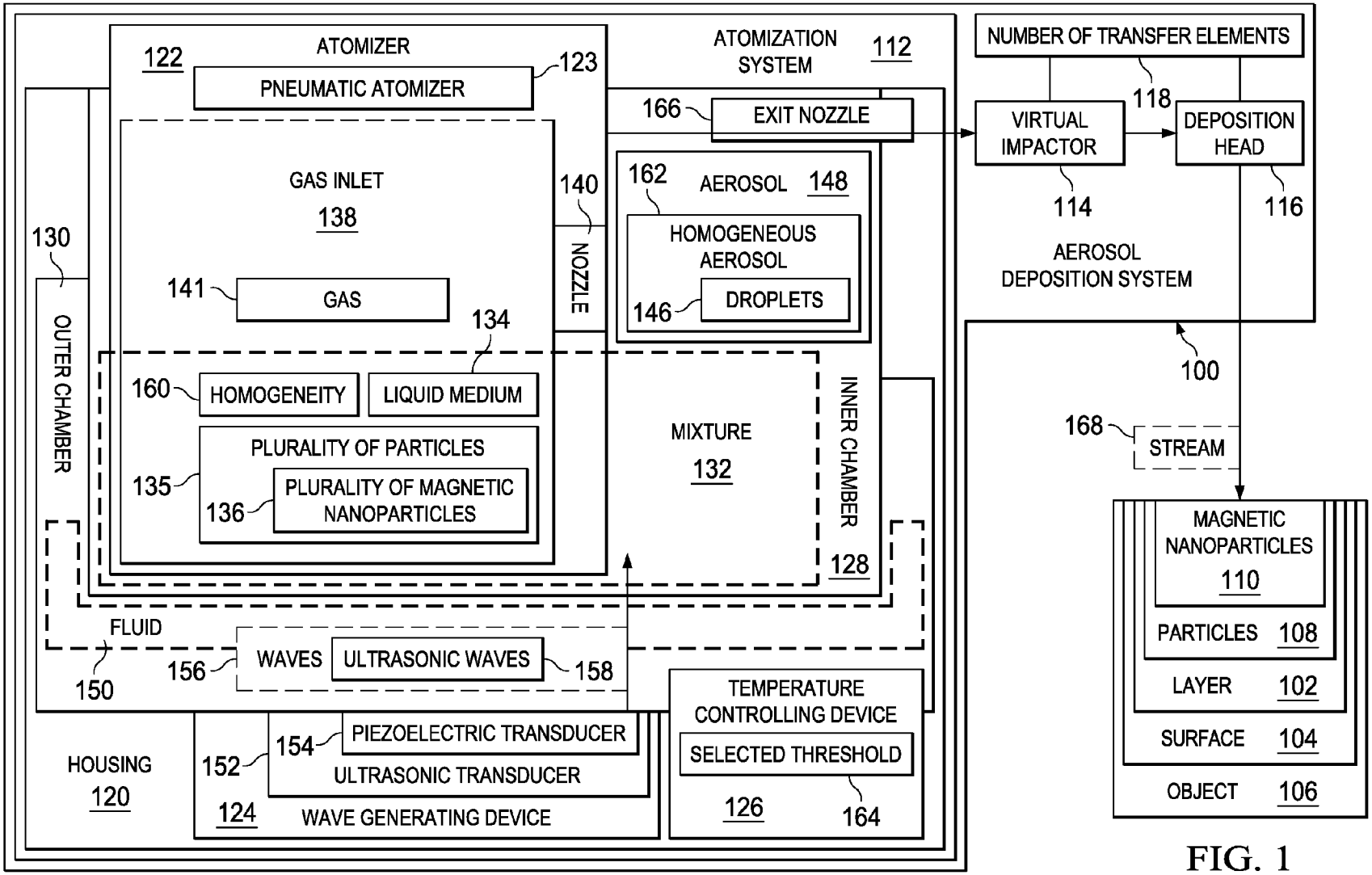
FIG. 1 is an illustration of an aerosol deposition system in the form of a block diagram in accordance with an illustrative embodiment.

Referring now to the figures and, in particular, with reference to FIG. 1, an illustration of an aerosol deposition system is depicted in the form of a block diagram in accordance with an illustrative embodiment. In this illustrative example, aerosol deposition system 100 may be used to form layer 102 over surface 104 of object 106.

Layer 102 may be a continuous or discontinuous layer of particles 108. In some cases, layer 102 may be referred to as a "deposit" of particles 108. Particles 108 may be magnetic nanoparticles 110 in this illustrative example. As used herein, a "nanoparticle," such as one of magnetic nanoparticles 110, may be a particle between about 1 and 100 nanometers in size. Of course, in other illustrative examples, particles 108 may not be nanoparticles and may be larger than about 100 nanometers or smaller than about 1 nanometer.

Aerosol deposition system 100 may include atomization system 112, virtual impactor 114, deposition head 116, and number of transfer elements 118. As used herein, a "number of" items may include one or more items. In this manner, number of transfer elements 118 may include one or more elements.

As depicted, atomization system 112 may include housing 120, atomizer 122, wave generating device 124, and temperature-controlling device 126. In this illustrative example, atomizer 122, wave generating device 124, and temperature-controlling device 126 may be associated with housing 120.

As used herein, when one component is "associated" with another component, the association is a physical association in the depicted examples. For example, a first component, such as atomizer 122, may be considered to be associated with a second component, such as housing 120, by being at least one of secured to the second component, bonded to the second component, mounted to the second component, welded to the second component, fastened to the second component, or connected to the second component in some other suitable manner. The first component also may be connected to the second component using a third component. Further, the first component may be considered to be associated with the second component by being formed as part of the second component, an extension of the second component, or both.

As used herein, the phrase "at least one of," when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required.

For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Housing 120 may be configured to form inner chamber 128 and outer chamber 130 within housing 120. Outer chamber 130 may be located around inner chamber 128. In particular, outer chamber 130 may at least partially surround inner chamber 128.

Inner chamber 128 may be configured to hold mixture 132. In some illustrative examples, mixture 132 may take the form of a colloid or suspension.

Mixture 132 may be comprised of liquid medium 134 and plurality of particles 135. Liquid medium 134 may take a number of forms. Liquid medium 134 may be comprised of, for example, without limitation, at least one of water, isopropyl alcohol, ethylene glycol, or some other type of liquid. In some cases, liquid medium 134 may be a type of solution.

In this illustrative example, plurality of particles 135 may take the form of plurality of magnetic nanoparticles 136. Plurality of magnetic nanoparticles 136 may be comprised of magnetic elements. These magnetic elements may include, for example, without limitation, at least one of iron, nickel, cobalt, or some other type of magnetic element. Of course, in other illustrative examples, plurality of particles 135 may be a plurality of nonmagnetic nanoparticles.

Atomizer 122 may be configured to convert at least a portion of mixture 132 into very fine particles or droplets. In other words, atomizer 122 may be configured to atomize at least a portion of mixture 132 held within inner chamber 128 to form aerosol 148. As depicted, atomizer 122 may take the form of pneumatic atomizer 123 and may include gas inlet 138 and nozzle 140 associated with gas inlet 138. Gas inlet 138 may be associated with housing 120 and may be positioned such that a portion of gas inlet 138 is located within inner chamber 128. In particular, gas inlet 138 may be positioned such that one end of gas inlet 138 is immersed in mixture 132 held within inner chamber 128.

Gas 141 may flow through gas inlet 138 towards mixture 132 and out of nozzle 140 at a velocity sufficiently high to create a vacuum pressure that draws mixture 132 into gas inlet 138 and to shear mixture 132 into droplets 146 to form aerosol 148. More specifically, contact between mixture 132 and the high-velocity stream of gas 141 through gas inlet 138 may cause mixture 132 to shear and exit nozzle 140 as droplets 146 that form aerosol 148 within inner chamber 128. Mixture 132 may "shear" by separating into droplets 146.

In this illustrative example, outer chamber 130 may hold fluid 150. Fluid 150 may take the form of, for example, without limitation, water. In some illustrative examples, fluid 150 may be comprised of water, ethylene glycol, one or more other types of liquid, or some combination thereof.

Wave generating device 124 may be configured to generate waves 156. In one illustrative example, wave generating device 124 may be attached to the outside of outer chamber 130. In another illustrative example, wave generating device 124 may be attached to the inside of outer chamber 130. In yet another illustrative example, wave generating device 124 may be located within the wall of housing 120 that forms outer chamber 130.

In one illustrative example, wave generating device 124 may take the form of ultrasonic transducer 152 configured to generate waves 156 in the form of ultrasonic waves 158. Ultrasonic waves 158 may be waves having a frequency greater than the upper limit of the human hearing range. For example, ultrasonic waves 158 may have a frequency greater than about 20 kilohertz. Depending on the type of ultrasonic transducer 152 used, ultrasonic waves 158 may have frequencies up to about 10 megahertz or up to several gigahertz. Ultrasonic transducer 152 may be implemented using piezoelectric transducer 154.

Wave generating device 124 may be associated with outer chamber 130 such that waves 156 propagate through fluid 150 within outer chamber 130 into mixture 132 within inner chamber 128. Waves 156 passing through mixture 132 may cause stirring, which helps maintain homogeneity 160 of mixture 132. In this manner, mixture 132 may be ultrasonically stirred when waves 156 take the form of ultrasonic waves 158. Homogeneity 160 may be the quality or state of being homogeneous. As used herein, "homogeneous" may mean having a substantially even distribution. In this manner, mixture 132 may be homogeneous when plurality of magnetic nanoparticles 136 is substantially evenly distributed within mixture 132. By maintaining homogeneity 160 of mixture 132 held within inner chamber 128, aerosol 148 that is produced may also be homogenous. In other words, aerosol 148 may take the form of homogeneous aerosol 162.

In this illustrative example, temperature-controlling device 126 may be used to control the temperature of fluid 150 within outer chamber 130 and the temperature of wave generating device 124. In particular, temperature-controlling device 126 may be configured to maintain the temperature of fluid 150 above selected threshold 164. By controlling the temperature of fluid 150, the temperature of mixture 132 within inner chamber 128 may also be controlled. Keeping the temperature of mixture 132 above selected threshold 164 may help maintain homogeneity 160 of mixture 132. In particular, controlling the temperature of mixture 132 may help prevent mixture 132 from clumping or agglomerating. Further, controlling the temperature of mixture 132 may help prevent mixture 132 from degrading. Additionally, temperature-controlling device 126 may be used to prevent wave generating device 124 from overheating.

As depicted, exit nozzle 166 may be associated with housing 120. Aerosol 148 may be allowed to exit atomization system 112 through exit nozzle 166 and flow towards virtual impactor 114. At least one of number of transfer elements 118 may connect exit nozzle 166 to virtual impactor 114 to allow aerosol 148 to flow from exit nozzle 166 to virtual impactor 114.

Virtual impactor 114 may be used to form stream 168 of aerosol 148 that may exit aerosol deposition system 100 through deposition head 116. In some cases, deposition head 116 may be connected directly to virtual impactor 114. In other illustrative examples, at least one of number of transfer elements 118 may connect virtual impactor 114 to deposition head 116 and allow stream 168 of aerosol 148 to flow from virtual impactor 114 to deposition head 116. Stream 168 of magnetic nanoparticles 110 within aerosol 148 may exit deposition head 116 towards surface 104 of object 106 such that magnetic nanoparticles 110 may be deposited onto surface 104 of object 106. This process of depositing magnetic nanoparticles 110 onto surface 104 of object 106 using aerosol 148 may be referred to as aerosol jet deposition.

The illustration of aerosol deposition system 100 in FIG. 1 is not meant to imply physical or architectural limitations to the manner in which an illustrative embodiment may be implemented. Other components in addition to or in place of the ones illustrated may be used. Some components may be optional. Also, the blocks are presented to illustrate some functional components. One or more of these blocks may be combined, divided, or combined and divided into different blocks when implemented in an illustrative embodiment.

For example, waves 156 may take the form of another type of acoustic waves other than ultrasonic waves 158. In some cases, atomization system 112 may not include temperature-controlling device 126 in other illustrative examples. Further, although plurality of particles 135 is described as taking the form of plurality of magnetic nanoparticles 136, plurality of particles 135 may take the form of plurality of nonmagnetic nanoparticles in some illustrative examples.

Further, although aerosol 148 is described as exiting deposition head 116 as stream 168 of magnetic nanoparticles 110, when plurality of particles 135 takes the form of nonmagnetic nanoparticles, stream 168 may be of nonmagnetic nanoparticles. In this manner, stream 168 may be referred to as stream 168 of nanoparticles.

Figure 2:
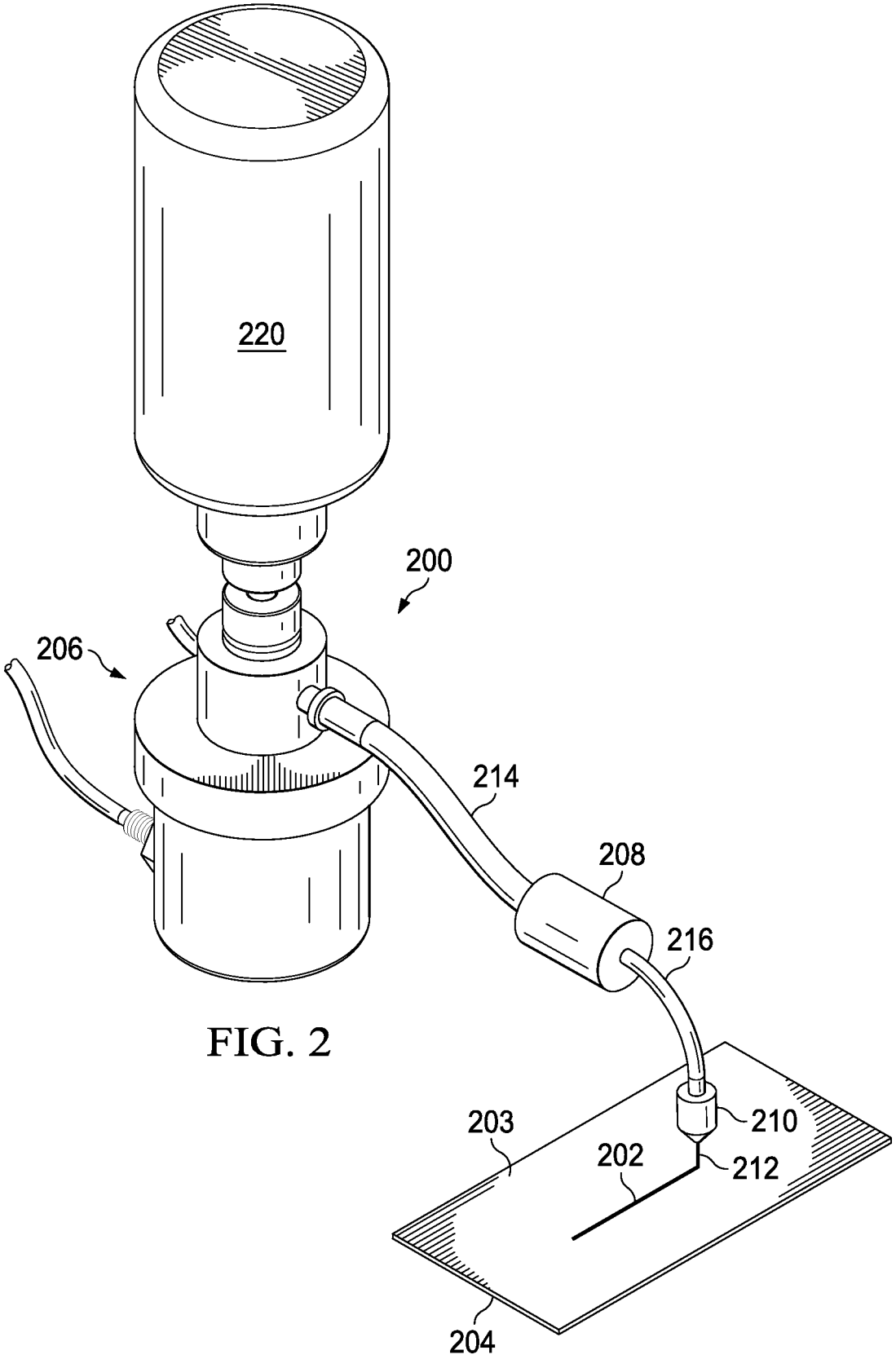
FIG. 2 is an illustration of an aerosol deposition system in accordance with an illustrative embodiment.

With reference now to FIG. 2, an illustration of an aerosol deposition system is depicted in accordance with an illustrative embodiment. In FIG. 2, aerosol deposition system 200 is an example of one implementation for aerosol deposition system 100 in FIG. 1. As depicted, aerosol deposition system 200 may be used to deposit magnetic nanoparticles 202 onto surface 203 of object 204. Magnetic nanoparticles 202 may be an example of one implementation for magnetic nanoparticles 110 in FIG. 1.

Aerosol deposition system 200 may include atomization system 206, virtual impactor 208, and deposition head 210, which may be examples of implementations for atomization system 112, virtual impactor 114, and deposition head 116, respectively, in FIG. 1. Stream 212 may be configured to exit deposition head 210 to deposit magnetic nanoparticles 202 onto object 204. Stream 212 may be an example of one implementation for stream 168 in FIG. 1.

In this illustrative example, tube 214 connects atomization system 206 to virtual impactor 208. Tube 216 connects virtual impactor 208 to deposition head 210. Tube 214 and tube 216 may be examples of one implementation for number of transfer elements 118 in FIG. 1.

As depicted, gas cartridge 220 may be connected to atomization system 206. Gas cartridge 220 may store nitrogen gas, which may be used by the atomizer (not shown in this view) within atomization system 206. This nitrogen gas may be an example of one implementation for gas 141 in FIG. 1.

Figure 3:
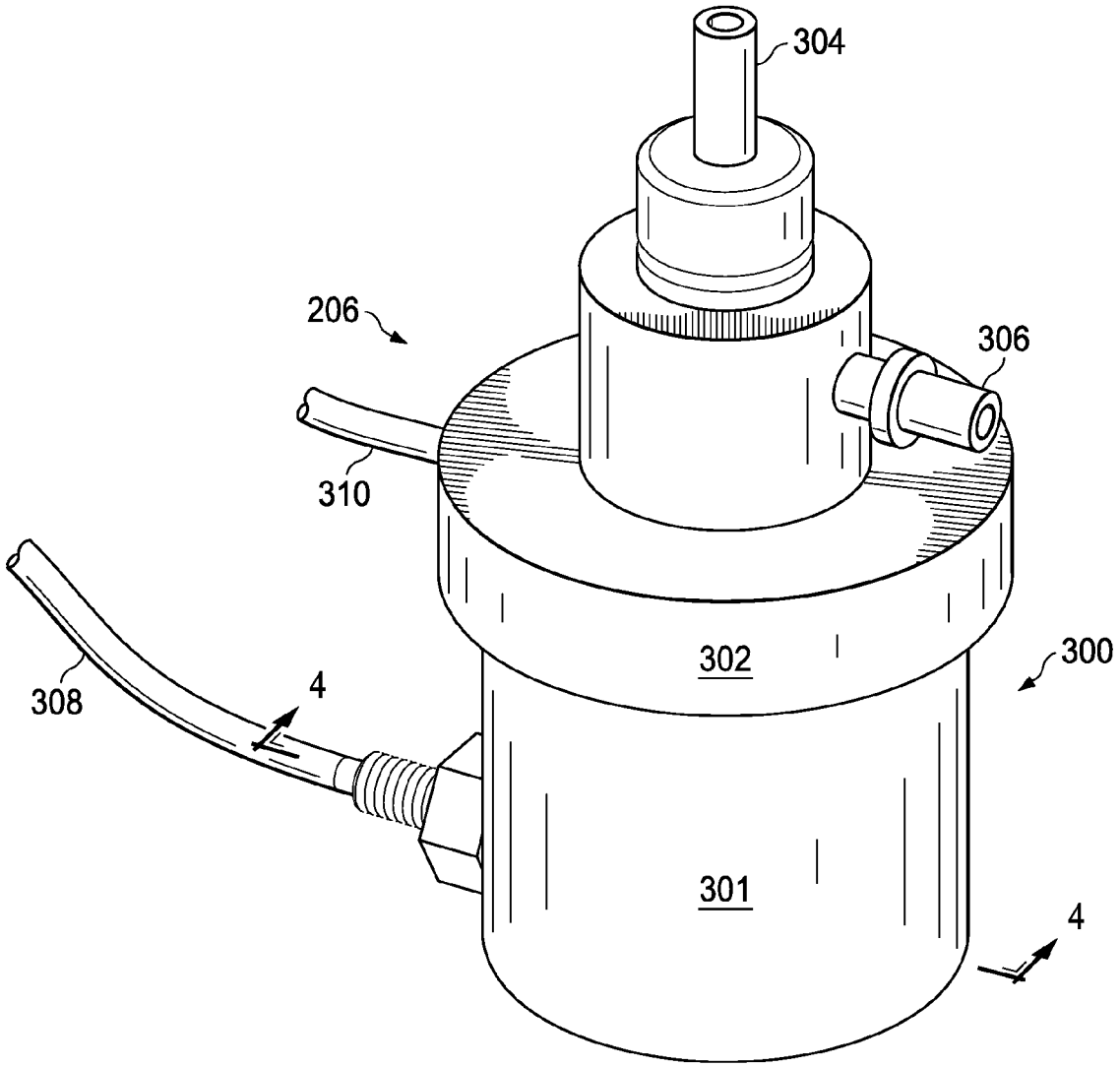
FIG. 3 is an illustration of an enlarged view of an atomization system in accordance with an illustrative embodiment.

With reference now to FIG. 3, an illustration of an enlarged view of atomization system 206 from FIG. 2 is depicted in accordance with an illustrative embodiment. As depicted, atomization system 206 may include housing 300. Housing 300 may be an example of one implementation for housing 120 in FIG. 1. Housing 300 may include body 301 and lid 302.

In this illustrative example, gas inlet 304 may be seen. Gas inlet 304 may be an example of one implementation for gas inlet 138 in FIG. 1. Gas inlet 304 may be configured to receive nitrogen gas from gas cartridge 220 in FIG. 2.

Exit nozzle 306 may be associated with housing 300. Exit nozzle 306 may be an example of one implementation for exit nozzle 166 in FIG. 1. The aerosol produced by atomization system 206 may flow through exit nozzle 166 into virtual impactor 208 in FIG. 2.

As depicted, inlet 308 and outlet 310 may be associated with housing 300. Inlet 308 may allow a fluid, such as water, to flow inside housing 300. Outlet 310 may allow the fluid to flow out of housing 300.

Figure 4:
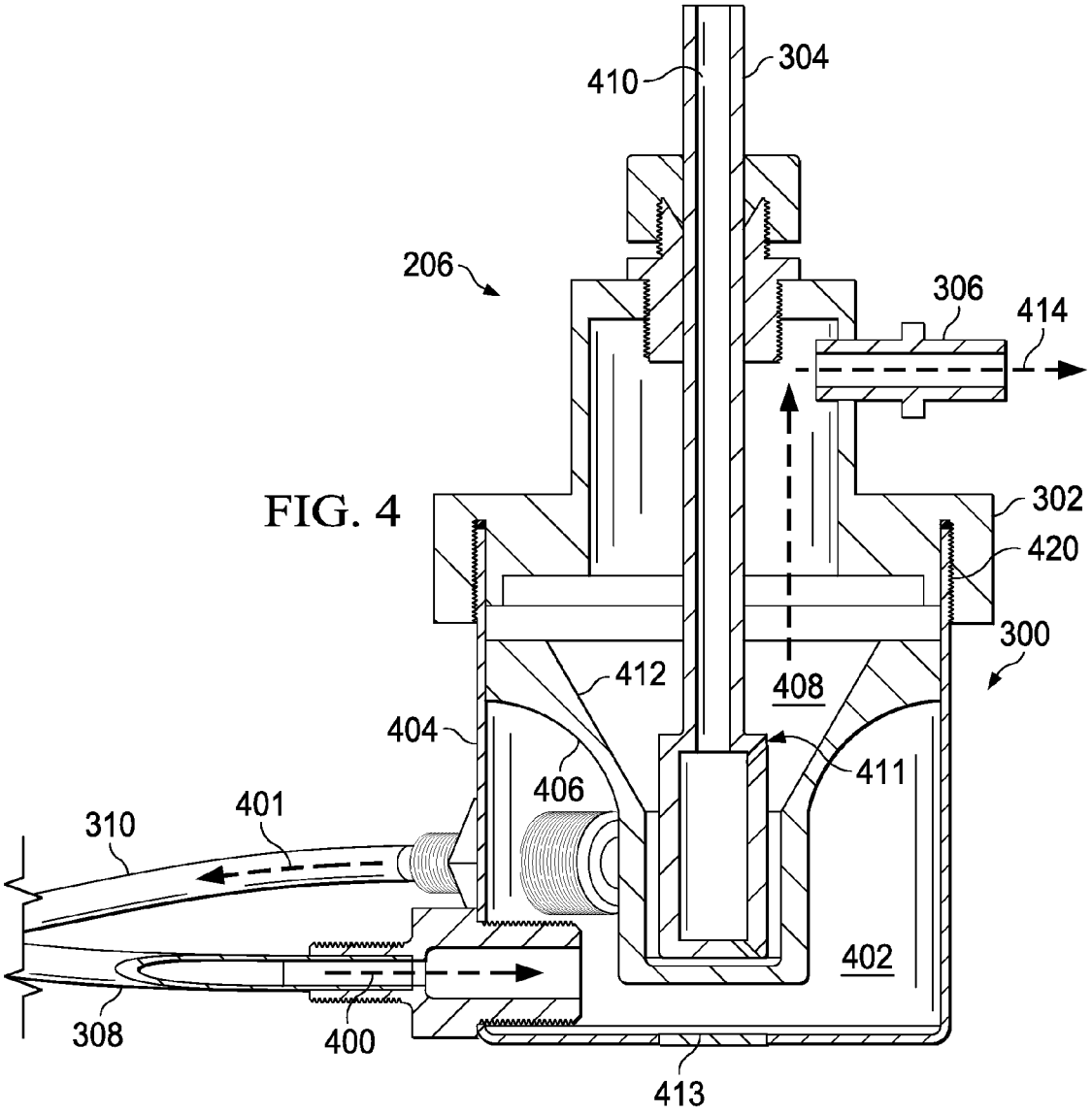
FIG. 4 is an illustration of a cross-sectional view of an atomization system in accordance with an illustrative embodiment.

With reference now to FIG. 4, an illustration of a cross-sectional view of atomization system 206 from FIG. 3 is depicted in accordance with an illustrative embodiment. A cross-sectional view of atomization system 206 is taken with respect to lines 4-4 in FIG. 3.

As depicted, fluid may enter housing 300 in the direction of arrow 400 through inlet 308 and may exit housing 300 in the direction of arrow 401 through outlet 310. In particular, fluid may enter outer chamber 402 formed within housing 300 between wall 404 and wall 406. Outer chamber 402 may be located around inner chamber 408. Inner chamber 408 may be formed within housing 300 between wall 410 and lid 302. Lid 302 may engage threads 420 of housing 300. Inner chamber 408 and outer chamber 402 may be examples of implementations for inner chamber 128 and outer chamber 130, respectively, in FIG. 1.

In this illustrative example, inner chamber 408 may be configured to hold a mixture, such as mixture 132 in FIG. 1. Gas inlet 304 may be positioned such that a portion of gas inlet 304 is located within inner chamber 408. As depicted, nozzle 411 may be associated with gas inlet 304. Nozzle 411 may allow the contents of gas inlet 304 to exit gas inlet 304 into inner chamber 408. Together, gas inlet 304 and nozzle 411 may form atomizer 412.

Ultrasonic transducer 413 may be associated with housing 300 and configured to generate ultrasonic waves. Ultrasonic transducer 413 may be an example of one implementation for ultrasonic transducer 152 in FIG. 1.

Atomizer 412 may be used to atomize the mixture held within inner chamber 408 to form an aerosol that may exit atomization system 206 in the direction of arrow 414 through exit nozzle 306.

Figure 5:
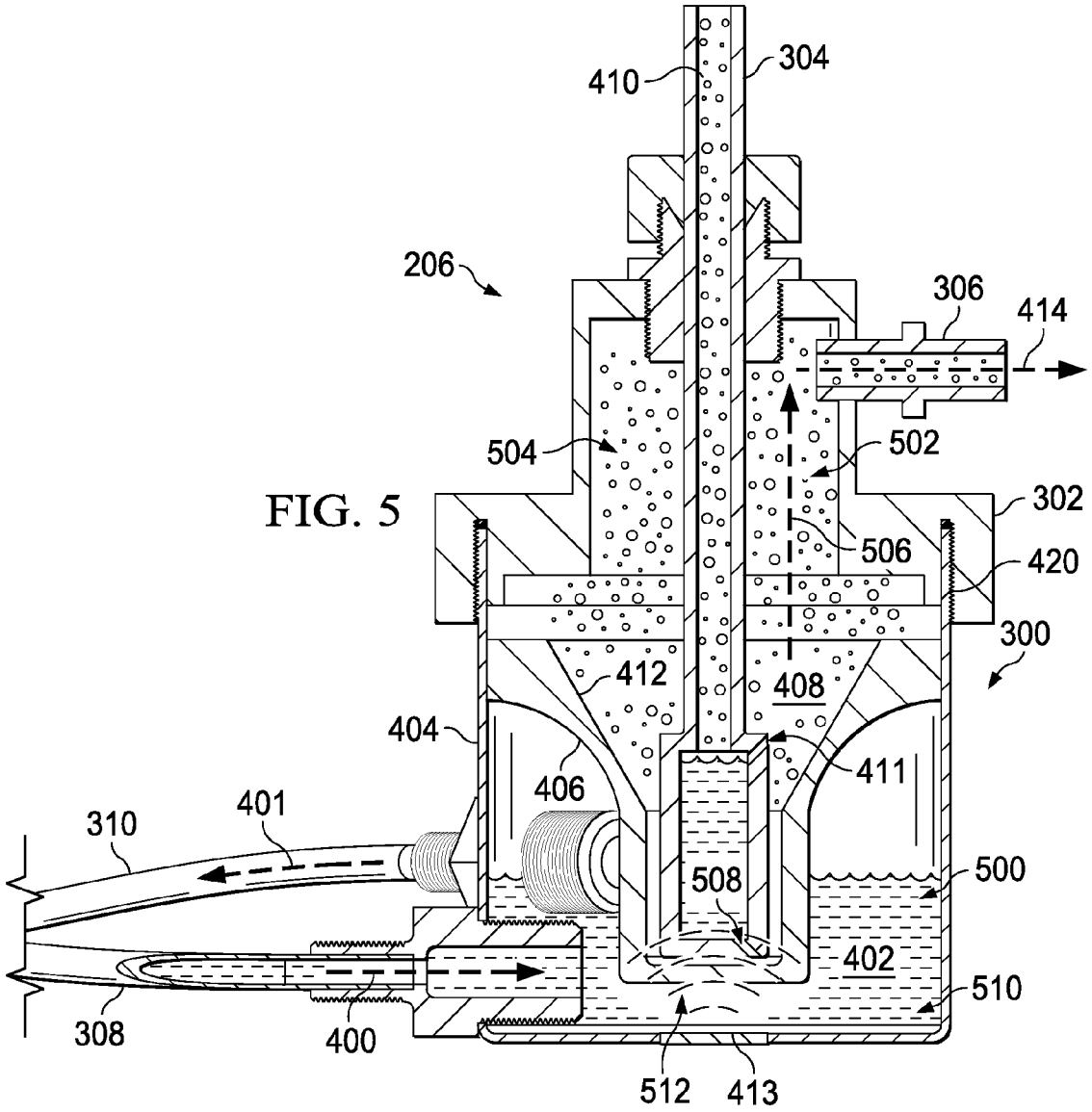
FIG. 5 is an illustration of a cross-sectional view an atomization system containing water and a mixture in accordance with an illustrative embodiment.

With reference now to FIG. 5, an illustration of atomization system 206 from FIG. 4 containing water and a mixture is depicted in accordance with an illustrative embodiment. As depicted, water 500 is being held within outer chamber 402. Water 500 may be an example of one implementation for fluid 150 in FIG. 1. Mixture 502 is being held within inner chamber 408. Mixture 502 may be an example of one implementation for mixture 132 in FIG. 1.

As depicted, a high-velocity stream of nitrogen gas 504 may flow in the direction of arrow 506 through gas inlet 304 and out of nozzle 411. The velocity of this flow of nitrogen gas 504 may be sufficiently high to create a vacuum pressure within gas inlet 304 that draws mixture 502 into gas inlet 304 through opening 508. Once mixture 502 reaches the level of nozzle 411, the impact of nitrogen gas 504 across mixture 502 causes shearing of mixture 502 into droplets that are dispersed within inner chamber 408 through nozzle 411 to form aerosol 510.

Ultrasonic waves 512 generated by ultrasonic transducer 413 may propagate through water 500 and into mixture 502 to stir mixture 502 to help maintain the homogeneity of mixture 502. Thus, aerosol 510 produced may be a homogeneous aerosol.

The illustrations of aerosol deposition system 200 in FIG. 2 and atomization system 206 in FIGS. 2-5 are not meant to imply physical or architectural limitations to the manner in which an illustrative embodiment may be implemented. Other components in addition to or in place of the ones illustrated may be used. Some components may be optional.

The different components shown in FIGS. 2-5 may be illustrative examples of how components shown in block form in FIG. 1 can be implemented as physical structures. Additionally, some of the components in FIGS. 2-5 may be combined with components in FIG. 1, used with components in FIG. 1, or a combination of the two.

Figure 6:
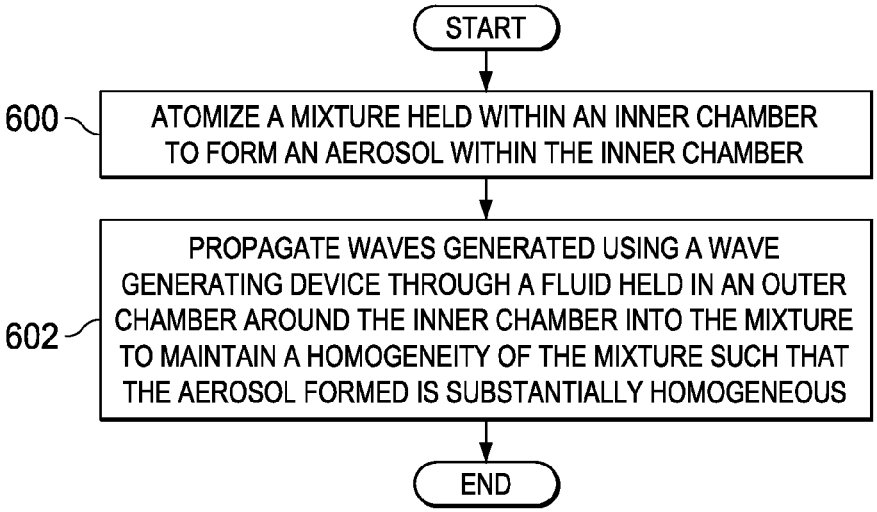
FIG. 6 is an illustration of a process for forming an aerosol in the form of a flowchart in accordance with an illustrative embodiment.

With reference now to FIG. 6, an illustration of a process for forming an aerosol is depicted in the form of a flowchart in accordance with an illustrative embodiment. The process illustrated in FIG. 6 may be used to produce aerosol 148 in FIG. 1.

Mixture 132 held within inner chamber 128 may be atomized to form aerosol 148 within inner chamber 128 (operation 600). Waves 156 generated using wave generating device 124 may be propagated through fluid 150 held in outer chamber 130 around inner chamber 128 into mixture 132 to maintain homogeneity 160 of mixture 132 such that aerosol 148 formed is substantially homogeneous (operation 602), with the process terminating thereafter.

Figure 7:
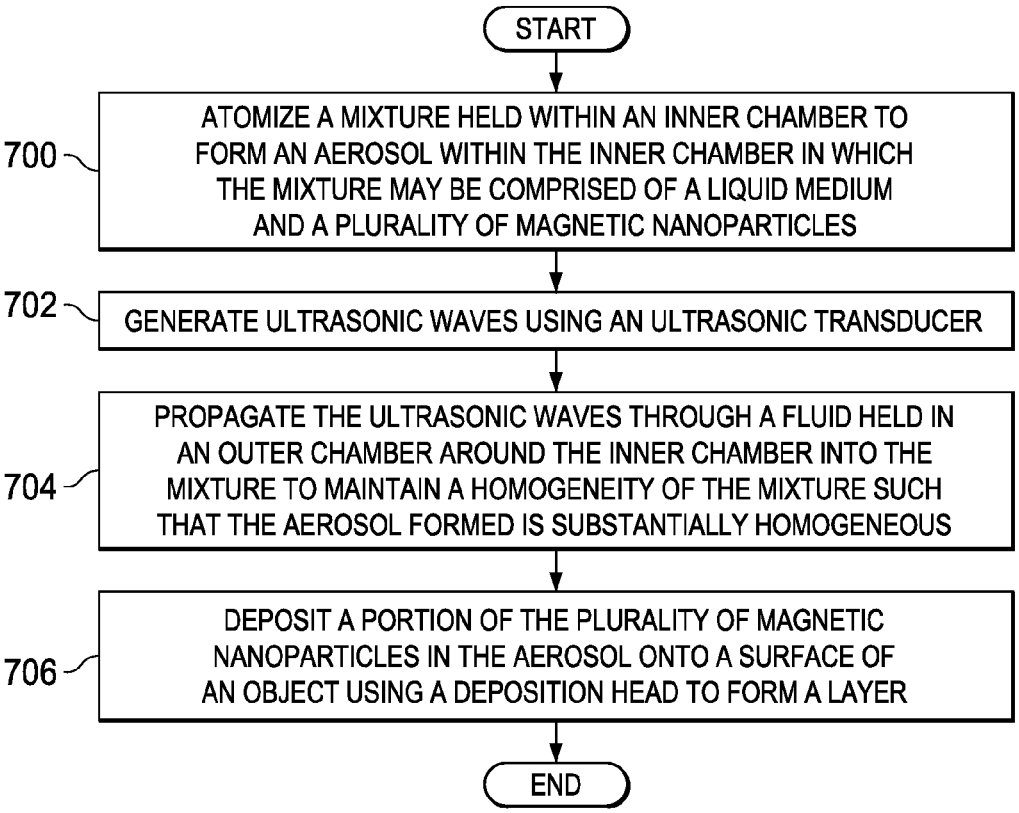
FIG. 7 is an illustration of a process for performing aerosol deposition in the form of a flowchart in accordance with an illustrative embodiment.

With reference now to FIG. 7, an illustration of a process for performing aerosol deposition is depicted in the form of a flowchart in accordance with an illustrative embodiment. The process illustrated in FIG. 7 may be used to perform aerosol deposition using aerosol deposition system 100 in FIG. 1.

Mixture 132 held within inner chamber 128 may be atomized to form aerosol 148 within inner chamber 128 in which mixture 132 may comprise liquid medium 134 and plurality of magnetic nanoparticles 136 (operation 700). Ultrasonic waves 158 may be generated using ultrasonic transducer 152 (operation 702). Ultrasonic waves 158 may be propagated through fluid 150 held in outer chamber 130 around inner chamber 128 into mixture 132 to maintain homogeneity 160 of mixture 132 such that aerosol 148 formed is substantially homogeneous (operation 704). A portion of plurality of magnetic nanoparticles 136 in aerosol 148 may be deposited onto surface 104 of object 106 using deposition head 116 to form layer 102 (operation 706), with the process terminating thereafter. The quality of layer 102 formed when aerosol 148 is substantially homogeneous is improved as compared to the quality of layer 102 formed when aerosol 148 is heterogeneous.

The flowcharts and block diagrams in the different depicted embodiments illustrate the architecture, functionality, and operation of some possible implementations of apparatuses and methods in an illustrative embodiment. In this regard, each block in the flowcharts or block diagrams may represent a module, a segment, a function, a portion of an operation or step, some combination thereof.

In some alternative implementations of an illustrative embodiment, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

Illustrative embodiments of the disclosure may be described in the context of aircraft manufacturing and service method 800 as shown in FIG. 8 and aircraft 900 as shown in FIG. 9. Turning first to FIG. 8, an illustration of an aircraft manufacturing and service method is depicted in the form of a block diagram in accordance with an illustrative embodiment. During pre-production, aircraft manufacturing and service method 800 may include specification and design 802 of aircraft 900 in FIG. 9 and material procurement 804.

During production, component and subassembly manufacturing 806 and system integration 808 of aircraft 900 in FIG. 9 takes place. Thereafter, aircraft 900 in FIG. 9 may go through certification and delivery 810 in order to be placed in service 812. While in service 812 by a customer, aircraft 900 in FIG. 9 is scheduled for routine maintenance and service 814, which may include modification, reconfiguration, refurbishment, and other maintenance or service.

Each of the processes of aircraft manufacturing and service method 800 may be performed or carried out by at least one of a system integrator, a third party, or an operator. In these examples, the operator may be a customer. For the purposes of this description, a system integrator may include, without limitation, any number of aircraft manufacturers and major-system subcontractors; a third party may include, without limitation, any number of vendors, subcontractors, and suppliers; and an operator may be an airline, a leasing company, a military entity, a service organization, and so on.

With reference now to FIG. 9, an illustration of an aircraft is depicted in the form of a block diagram in which an illustrative embodiment may be implemented. In this example, aircraft 900 is produced by aircraft manufacturing and service method 800 in FIG. 8 and may include airframe 902 with plurality of systems 904 and interior 906. Examples of systems 904 include one or more of propulsion system 908, electrical system 910, hydraulic system 912, and environmental system 914. Any number of other systems may be included. Although an aerospace example is shown, different illustrative embodiments may be applied to other industries, such as the automotive industry.

Apparatuses and methods embodied herein may be employed during at least one of the stages of aircraft manufacturing and service method 800 in FIG. 8. In particular, aerosol deposition system 100 from FIG. 1 may be used to form electronic devices for aircraft 900 during any one of the stages of aircraft manufacturing and service method 800. For example, without limitation, aerosol deposition system 100 from FIG. 1 may be used to form printed circuit boards and other types of electronic devices for use in any one of systems 904, including, but not limited to environmental system 914, electrical system 910, and propulsion system 908. Further, aerosol deposition system 100 may be used during at least one of component and subassembly manufacturing 806, system integration 808, routine maintenance and service 814, or some other stage of aircraft manufacturing and service method 800.

In one illustrative example, components or subassemblies produced in component and subassembly manufacturing 806 in FIG. 8 may be fabricated or manufactured in a manner similar to components or subassemblies produced while aircraft 900 is in service 812 in FIG. 8. As yet another example, one or more apparatus embodiments, method embodiments, or a combination thereof may be utilized during production stages, such as component and subassembly manufacturing 806 and system integration 808 in FIG. 8. One or more apparatus embodiments, method embodiments, or a combination thereof may be utilized while aircraft 900 is in service 812, during maintenance and service 814 in FIG. 8, or both. The use of a number of the different illustrative embodiments may substantially expedite the assembly of and reduce the cost of aircraft 900.

Thus, the illustrative embodiments provide a method and apparatus for forming aerosol 148. An apparatus may comprise inner chamber 128, outer chamber 130 located around inner chamber 128, and wave generating device 124 associated with outer chamber 130. Inner chamber 128 may be configured to hold mixture 132 that is to be atomized to form aerosol 148 within inner chamber 128. Outer chamber 130 may be configured to hold fluid 150. Wave generating device 124 may be configured to generate waves 156 that propagate through fluid 150 into mixture 132 to maintain homogeneity 160 of mixture 132 such that aerosol 148 formed is substantially homogeneous. In this manner, the print quality produced by aerosol 148 may be improved.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other desirable embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus comprising:

an inner chamber configured to hold a mixture that is to be converted into an aerosol within the inner chamber;

an outer chamber located around and substantially surrounding the inner chamber, and configured to hold a liquid fluid; and a wave generating device associated with the outer chamber and configured to generate waves that propagate through the liquid fluid into the mixture to stir the mixture; and a pneumatic atomizer configured to atomize the mixture to form the aerosol, the pneumatic atomizer comprising a gas inlet and a nozzle held within the inner chamber and associated with the gas inlet, wherein a gas flows through the gas inlet and out of the nozzle at a velocity sufficiently high to create a vacuum pressure that draws the mixture into the gas inlet and to shear the mixture into droplets to form the aerosol.

2. The apparatus of claim 1, wherein stirring of the mixture by the wave generating device maintains homogeneity of the mixture such that the aerosol formed is substantially homogeneous.

3. The apparatus of claim 1, further comprising:

the liquid fluid held within the outer chamber, wherein the fluid consists essentially of water.

4. The apparatus of claim 1, wherein the wave generating device is an ultrasonic transducer.

5. The apparatus of claim 4, wherein the ultrasonic transducer is a piezoelectric transducer.

6. The apparatus of claim 1, wherein the waves are ultrasonic waves.

7. The apparatus of claim 1 further comprising:

a temperature-controlling device configured to maintain a temperature of the fluid above a selected threshold to maintain a temperature of the mixture above the selected threshold.

8. The apparatus of claim 1, further comprising:

a gas cartridge configured to supply the gas to the gas inlet, wherein the gas consists essentially of nitrogen gas.

9. The apparatus of claim 1, further comprising:

the mixture, wherein the mixture comprises:

a liquid medium; and a plurality of magnetic nanoparticles.

10. The apparatus of claim 9, wherein the plurality of magnetic nanoparticles comprises elements of at least one of iron, nickel, or cobalt.

11. The apparatus of claim 9, wherein the liquid medium is comprised of at least one of water, ethylene glycol, or isopropyl alcohol.

12. The apparatus of claim 1, wherein the aerosol formed by the atomizer is used to form a stream of nanoparticles that are to be deposited on a surface of an object.

13. An atomization system comprising:

an inner chamber configured to hold a mixture comprised of a liquid medium and a plurality of magnetic nanoparticles;

a pneumatic atomizer configured to atomize the mixture using a high-velocity stream of gas to form an aerosol, the pneumatic atomizer comprising a gas inlet and a nozzle held within the inner chamber and associated with the gas inlet, wherein the gas flows through the gas inlet and out of the nozzle at a velocity sufficiently high to create a vacuum pressure that draws the mixture into the gas inlet and to shear the mixture into droplets to form the aerosol;

an outer chamber located around the inner chamber and configured to hold a fluid;

an ultrasonic transducer associated with the outer chamber and configured to generate ultrasonic waves that propagate through the fluid into the mixture to ultrasonically stir the mixture to maintain homogeneity of the mixture such that the aerosol formed is substantially homogeneous; and a temperature-controlling device configured to maintain a temperature of the fluid above a selected threshold to maintain a temperature of the mixture above the selected threshold.

* * * * *